US008365933B2

(12) United States Patent
Jäckel

(10) Patent No.: US 8,365,933 B2
(45) Date of Patent: Feb. 5, 2013

(54) CLOSURE SYSTEM FOR A CONTAINER AND DISPENSING CLOSURE

(75) Inventor: Gerhard F. K. Jäckel, Freyung (DE)

(73) Assignee: Aptar Freyung GmbH, Freyung (DE)

( * ) Notice: Subject to any disclaimer, the term of this patent is extended or adjusted under 35 U.S.C. 154(b) by 112 days.

(21) Appl. No.: 12/669,010

(22) PCT Filed: Jul. 13, 2007

(86) PCT No.: PCT/EP2007/006248

§ 371 (c)(1),
(2), (4) Date: Jun. 18, 2010

(87) PCT Pub. No.: WO2009/010075

PCT Pub. Date: Jan. 22, 2009

(65) Prior Publication Data

US 2010/0288787 A1 Nov. 18, 2010

(51) Int. Cl.
*B65D 41/04* (2006.01)

(52) U.S. Cl. ..... 215/318; 215/330; 215/331; 215/235; 222/549; 222/556

(58) Field of Classification Search ..... 215/235, 215/237, 317, 318, 330, 331; 220/254.3, 220/254.5; 222/556, 548, 549
See application file for complete search history.

(56) References Cited

U.S. PATENT DOCUMENTS

| | | | |
|---|---|---|---|
| 133,518 | A | 12/1872 | Burnap |
| 563,667 | A | 7/1896 | Hoffman |
| 911,485 | A | 2/1909 | Fitzgerald |
| 929,485 | A | 7/1909 | Plunkett |
| 1,459,589 | A | 6/1923 | Hoffman |
| 1,499,612 | A | 7/1924 | Hammer |
| 1,516,046 | A | 11/1924 | Lee |
| 1,669,579 | A | 5/1928 | Scofield |
| 1,849,523 | A | 3/1932 | Hammer |
| 1,858,163 | A | 5/1932 | De Boissac |
| 2,045,388 | A | 6/1936 | Guthrie |
| 2,063,157 | A | 12/1936 | Gray |
| 2,072,873 | A | 3/1937 | Fusting et al. |
| 2,153,426 | A | 4/1939 | McNamara et al. |

(Continued)

FOREIGN PATENT DOCUMENTS

| | | |
|---|---|---|
| AT | 236822 | 3/1964 |
| CA | 963845 | 3/1975 |

(Continued)

OTHER PUBLICATIONS

International Preliminary Report and Written Opinion for corresponding PCT application No. PCT/EP2007/006248 mailed Feb. 18, 2010.

(Continued)

*Primary Examiner* — Anthony Stashick
*Assistant Examiner* — James N Smalley
(74) *Attorney, Agent, or Firm* — Wood, Phillips, Katz, Clark & Mortimer

(57) ABSTRACT

The present invention relates to a closure system, which comprises a dispensing closure and a spout of a container or a spout for a container, to which the dispensing closure can be attached, wherein the dispensing closure is designed as a rebounding closure. The dispensing closure and spout are designed in such a way that the dispensing closure can be separated from the spout or container via a rotational motion. The invention also relates to a dispensing closure for such a closure system.

13 Claims, 5 Drawing Sheets

U.S. PATENT DOCUMENTS

| | | | |
|---|---|---|---|
| 2,168,594 | A | 8/1939 | Von Till |
| 2,264,792 | A | 12/1941 | Gray et al. |
| 2,423,295 | A | 7/1947 | Crabbe et al. |
| 2,733,052 | A | 1/1956 | Luther |
| 2,822,104 | A | 2/1958 | Busch |
| 3,101,856 | A | 8/1963 | Whitman, Jr. |
| 3,110,410 | A | 11/1963 | Pehr |
| 3,239,112 | A | 3/1966 | Porcelli |
| 3,260,422 | A | 7/1966 | Fillmore et al. |
| 3,269,617 | A | 8/1966 | Goth |
| 3,339,770 | A | 9/1967 | Weigand |
| 3,339,773 | A | 9/1967 | Stull |
| 3,372,834 | A | 3/1968 | Ayotte et al. |
| 3,435,978 | A | 4/1969 | Wittwer |
| 3,511,403 | A | 5/1970 | Braun |
| 3,612,324 | A | 10/1971 | Malick |
| 3,716,161 | A | 2/1973 | Jullian et al. |
| 3,805,987 | A | 4/1974 | Horvath |
| 3,809,276 | A | 5/1974 | Landen |
| 3,831,797 | A | 8/1974 | Stevens, Jr. |
| 3,910,444 | A | 10/1975 | Foster |
| 3,942,680 | A | 3/1976 | Seeley et al. |
| 3,951,289 | A | 4/1976 | Landen |
| 3,954,200 | A | 5/1976 | Willis |
| 3,973,941 | A | 8/1976 | Augeri |
| 3,993,208 | A | 11/1976 | Ostrowsky |
| 4,002,275 | A | 1/1977 | Crowle et al. |
| 4,007,848 | A | 2/1977 | Snyder |
| 4,022,352 | A | 5/1977 | Pehr |
| 4,036,385 | A | 7/1977 | Morris |
| 4,049,148 | A | 9/1977 | Suhr et al. |
| 4,051,974 | A | 10/1977 | Gentile |
| 4,053,078 | A | 10/1977 | Herr |
| 4,068,775 | A | 1/1978 | Palmer |
| 4,093,096 | A | 6/1978 | Augros |
| 4,098,419 | A | 7/1978 | Virog, Jr. et al. |
| 4,127,221 | A | 11/1978 | Vere |
| 4,134,513 | A | 1/1979 | Mumford |
| 4,144,983 | A | 3/1979 | Pauls et al. |
| 4,159,779 | A | 7/1979 | Hedgewick |
| 4,177,904 | A | 12/1979 | Puig Planas |
| 4,271,974 | A | 6/1981 | Quinard |
| 4,273,248 | A | 6/1981 | Lehmann |
| 4,280,632 | A | 7/1981 | Yuhara |
| 4,289,248 | A | 9/1981 | Lynn |
| 4,310,101 | A | 1/1982 | Sekine |
| 4,364,483 | A | 12/1982 | Golde |
| 4,365,721 | A | 12/1982 | Montgomery |
| 4,387,821 | A | 6/1983 | Geiger |
| 4,387,822 | A | 6/1983 | Lynn |
| 4,444,327 | A | 4/1984 | Hedgewick |
| 4,454,965 | A | 6/1984 | Kirk, Jr. |
| 4,456,136 | A | 6/1984 | Palsson |
| 4,496,066 | A | 1/1985 | Bullock, III |
| 4,519,518 | A | 5/1985 | Wiles et al. |
| 4,597,501 | A | 7/1986 | Gueret |
| 4,638,918 | A | 1/1987 | Marzabal Martinez |
| 4,645,096 | A | 2/1987 | Grant |
| 4,662,530 | A | 5/1987 | Goncalves |
| 4,669,624 | A | 6/1987 | Wiles et al. |
| 4,682,702 | A | 7/1987 | Gach |
| 4,691,833 | A | 9/1987 | Ahrens |
| 4,711,360 | A | 12/1987 | Ullman |
| 4,747,498 | A | 5/1988 | Gach |
| 4,763,801 | A | 8/1988 | Nycz |
| 4,763,804 | A | 8/1988 | O'Connell |
| 4,770,308 | A | 9/1988 | Lynn |
| 4,781,311 | A | 11/1988 | Dunning et al. |
| 4,799,597 | A | 1/1989 | Mayes et al. |
| 4,807,768 | A | 2/1989 | Gach |
| 4,815,616 | A | 3/1989 | Silvenis |
| 4,821,899 | A | 4/1989 | Nyez et al. |
| 4,858,777 | A | 8/1989 | Morel |
| 4,913,299 | A | 4/1990 | Petro |
| 4,936,475 | A | 6/1990 | Montgomery |
| 4,940,167 | A | 7/1990 | Fillmore et al. |
| 4,940,168 | A | 7/1990 | Shadwell et al. |
| 4,955,513 | A | 9/1990 | Bennett |
| 4,991,733 | A | 2/1991 | Marino |
| 5,133,471 | A | 7/1992 | Pujol Almirall |
| 5,141,347 | A | 8/1992 | Fitjer |
| 5,143,234 | A | 9/1992 | Lohrman |
| 5,145,080 | A | 9/1992 | Imbery, Jr. |
| 5,150,803 | A | 9/1992 | Cartellone |
| 5,160,057 | A | 11/1992 | Fitjer |
| 5,184,741 | A | 2/1993 | Chevassus et al. |
| 5,186,344 | A | 2/1993 | Cook |
| 5,213,223 | A | 5/1993 | Minnette |
| 5,213,225 | A | 5/1993 | King et al. |
| 5,279,434 | A | 1/1994 | Aguirrezabal |
| 5,292,020 | A | 3/1994 | Narin |
| 5,411,157 | A | 5/1995 | King et al. |
| 5,454,476 | A | 10/1995 | King et al. |
| 5,533,633 | A | 7/1996 | King |
| 5,547,091 | A | 8/1996 | Neveras et al. |
| 5,588,545 | A | 12/1996 | King |
| 5,676,270 | A | 10/1997 | Roberts |
| 5,690,241 | A | 11/1997 | Montgomery |
| 5,769,254 | A | 6/1998 | King et al. |
| 5,803,287 | A | 9/1998 | Kusz |
| 5,806,698 | A | 9/1998 | Aguirrezabal |
| 5,927,527 | A | 7/1999 | Montgomery |
| 5,944,208 | A | 8/1999 | Gale |
| 5,967,352 | A | 10/1999 | Repp |
| 5,984,123 | A | 11/1999 | Mogami et al. |
| 5,992,659 | A | 11/1999 | Nofer et al. |
| 5,992,668 | A | 11/1999 | Elliott |
| 6,056,136 | A | 5/2000 | Taber et al. |
| 6,082,565 | A | 7/2000 | Harrold |
| 6,112,921 | A | 9/2000 | Robinson |
| 6,173,853 | B1 | 1/2001 | Luch |
| 6,227,391 | B1 | 5/2001 | King |
| 6,378,713 | B2 | 4/2002 | Montgomery |
| 6,477,443 | B2 | 11/2002 | Salgado |
| 7,000,792 | B2 | 2/2006 | Arai |
| 7,055,708 | B1 | 6/2006 | Haffner et al. |
| 7,621,413 | B2 | 11/2009 | Miota et al. |
| 2001/0013523 | A1 | 8/2001 | Gross et al. |
| 2005/0051508 | A1 | 3/2005 | Hackmann et al. |
| 2005/0199572 | A1 | 9/2005 | Brozell |
| 2005/0205607 | A1 | 9/2005 | Hierzer et al. |
| 2007/0181523 | A1 | 8/2007 | Jäckel |

FOREIGN PATENT DOCUMENTS

| | | | |
|---|---|---|---|
| CH | 455545 | | 7/1968 |
| DE | 4037227 | | 7/1991 |
| DE | 29819652 | | 1/1999 |
| DE | 102004010845 | B3 | 5/2005 |
| DK | 109493 | | 4/1978 |
| EP | 0007274 | | 1/1980 |
| EP | 0011575 | | 5/1980 |
| EP | 0431915 | | 6/1991 |
| EP | 1452457 | A2 | 9/2004 |
| FR | 1560099 | | 2/1969 |
| FR | 77.39457 | | 7/1979 |
| FR | 90.06234 | | 11/1991 |
| GB | 225923 | | 12/1924 |
| GB | 2126565 | | 3/1984 |
| JP | 06024459 | A | 2/1994 |

OTHER PUBLICATIONS

Office Action dated Sep. 8, 2011 issued by the Canadian Intellectual Property Organization in Canadian patent application No. 2,696,000 which is a counterpart to the instant U.S. Appl. No. 12/669,010.

CLOSURE SYSTEM FOR A CONTAINER AND DISPENSING CLOSURE

FIELD OF THE INVENTION

The present invention relates to a closure system for a container, in particular for bottles, wherein the closure system comprises a dispensing closure and a spout of a container or a spout for a container to which the dispensing closure can be attached. The dispensing closure is designed as a so-called rebounding closure or snap-on closure (Prellverschluss), so that it essentially can be placed or forcibly pressed upon a spout of a container with a dispensing opening in essentially a straight line or in an axial direction, wherein two interacting elements, one on the spout and the other on the dispensing closure, are shifted by or over one another due to their flexibility afforded by the material itself or the geometry of the elements, so that the dispensing closure can only be taken off, removed or detached with difficulty, meaning only by exerting a certain force, also in the axial direction.

BACKGROUND OF THE INVENTION

Such closure systems and in particular dispensing closures are known in a variety of forms, and usually made out of a plastic material; however, they can also be made out of other materials, e.g., metals. Rebounding closure devices are also known in a variety of forms. The advantage to such rebounding closures is that they can be mounted relatively easily by pressing a dispensing closure onto a spout with a dispensing opening in essentially an axial direction.

After the container with closure system has been used, the dispensing closure typically remains on the dispensing opening, so that the dispensing closure remains on the container during recycling, even if the latter is made out of varying materials.

BRIEF SUMMARY OF THE INVENTION

The object of the present invention is to provide an improved closure system, which offers advantages in particular with regard to a possible ensuing recycling process.

This object is achieved by a closure system according to claim 1. Claims 2 to 13 relate to especially advantageous embodiments of the closure system according to the invention pursuant to claim 1.

According to the invention, the spout of a container with a dispensing opening is designed in such a way that a dispensing closure can be attached to the latter. Let it be pointed out at this juncture that the closure system according to the invention in many instances comprises a complete container, or the container is provided as a single piece with the spout and the dispensing opening. However, it is also possible for the closure system not to comprise a complete container, but only the spout with a dispensing opening, potentially accompanied by a shoulder area, possibly with an intermediate or partial product, such as a hose, which is only welded in a subsequent procedure, thereby forming a closed container, for example in the form of a tube. It is also possible to prepare a spout element with a dispensing opening that is only later joined or attached to a container, for example via welding or any other possible attachment methods.

According to the invention, the spout comprises an essentially cylindrical dispensing element with a dispensing opening, wherein the outside of the dispensing element is provided with at least one threaded segment. A shoulder area is preferably provided around the dispensing element.

The dispensing of the closure system according to the invention comprises an essentially cylindrical snap-on pipe, which is designed in such a way that it can comprise the dispensing element of the spout if the dispensing closure is attached to the dispensing opening, wherein the inside of the dispensing closure exhibits at least one threaded segment.

According to the invention, the outside of the dispensing element, preferably a shoulder area, is provided with a so-called forcing device, which is designed so as to interact with the snap-on pipe of the dispensing closure in such a way that the dispensing closure is forced to move in an axial direction when the dispensing closure attached to the spout is turned, thereby pressing the at least one threaded segment of the snap-on pipe over the at least one threaded segment of the dispensing element, detaching the dispensing closure from the spout.

The advantage to such a closure system is that, in order to detach a dispensing closure in the form of a rebounding closure, meaning to separate the dispensing closure from the spout or the container with the spout, by means of a rotational motion that is significantly easier to perform than an axial removal motion, a force can also be exerted in an axial direction on the dispensing closure relative to the spout and container, that the rebounding closure is released, i.e., the two interacting elements that hold the dispensing closure on the spout or dispensing element or entire container are also guided over each other in an axial direction against the direction of force, thereby releasing the rebounding closure.

In conventional rebounding closures, a force must be exerted on the dispensing closure exclusively in an axial direction to release the dispensing closure, which is appreciably more difficult for a user, in particular in closure devices whose outer shape is very much tailored to the outer shape of the container itself, so that there is virtually no way of exerting this relative, axial force between the two elements, dispensing closure on the one hand and container or spout on the other, or finding an approach for exerting the axial force.

In addition, the rotational motion is the motion the user is familiar with from conventional screwed connections, and will hence automatically use, automatically resulting in a release of the rebounding closure, wherein the user only has to exert a limited force solely in the rotational direction, automatically generating a conversion of force in the axial direction.

Therefore, the closure system combines the advantages of two fundamentally different closure system, specifically a rebounding closure on the one hand, and a rotary closure on the other, in particular in such a way that, when placing the dispensing closure on the container, for example after filling or while manufacturing the dispensing closure or container, the closure can be snapped on, in a manner very easy to demonstrate mechanically, while the dispensing closure can generally be removed more easily by the user from the container or spout prior to recycling or after use of the container essentially by means of a rotational motion, which is more easily executed during manual operation. The two advantages have previously always been viewed as incompatible, so that the user or manufacturer had to decide on one of the closure types.

A dispensing element preferably comprises two threaded segments, while a dispensing closure of a system according to the invention just as preferably comprises at least two threaded segments. These threaded segments are preferably arranged one opposite the other in the circumferential direction. The advantage to this is that it ensures a clear and reliably sustained positioning of the individual elements relative to each other over the entire circumference on the one hand, while simultaneously ensuring a uniform retaining or releasing force. The plurality of segments also ensures a more precisely defined positioning of the individual elements relative to each other.

The dispensing element preferably also comprises at least two forcing elements, which are preferably ramp-like in design. These forcing elements are also situated in essentially opposing positions in the circumferential direction in the preferred embodiment. The forcing elements can exhibit different shapes, for example, be essentially triangular viewed in a radial direction, while they exhibit a thickness or expansion in the radial direction that is greater than the corresponding radial expansion of the snap-on pipe. The correspondingly adjusted radial expansion of the forcing elements on the one hand and the snap-on pipe on the other ensures that the snap-on pipe and forcing element or forcing elements can interact in the manner described above, preventing the snap-on pipe, for example, from lying in a different position in its radial direction, thereby possibly not allowing it to interact with the forcing element(s).

The forcing element preferably has a ramp-like design at least on one side, wherein varying gradients can be provided, again viewed from a radial direction.

A gradient of the forcing element viewed in a radial direction from outside is preferably smaller on the left side than on the right side. The advantage to this is that, when the dispensing closure is turned relative to the container or spout in a counterclockwise direction, the usual rotational direction for opening a rotary closure, the snap-on pipe or a recess of a snap-on pipe can be guided along this gradient, wherein this gradient then determines the ratio between rotational angle to axial movement.

If a very high gradient is provided on the right side, meaning for a case where the dispensing closure is turned in the clockwise direction, the typical rotational direction for closing a rotary closure, which is preferably the case, for example, up to a perpendicular, or axially progressing gradient, movement in a clockwise direction is prevented or at least greatly impeded, while a counterclockwise movement for releasing the dispensing closure is assisted.

A gradient of the forcing element is preferably selected on the left side (again viewed radially from outside) that ranges between 20° and 60°, preferably between 30° and 50°, and in a particularly preferred embodiment from approx. 40° to 45°. By contrast, a gradient is preferably selected on the right side that is clearly higher, preferably 60° to 90°, preferably 75° to 89°. While a perpendicular gradient is also possible, a gradient is selected that at least partially lies below 90° to help "thread" while placing on the dispensing closure. Naturally, this can be provided in exactly the opposite or mirror-inverted manner as well.

It should also be pointed out that the gradient on each side of the forcing element van vary, meaning it absolutely odes not have to be constant. In the case of changing gradients even on one side of the forcing element, the aforementioned statements apply for preferred embodiments relative to at least one partial area or one point on the respective side of the forcing element.

The cylindrical snap-on pipe preferably comprises at least one recess, which is designed in such a way that it can at least partially accommodate or envelop at least one forcing device, in particular given a radially outward view of the closure system. The recess is preferably similar or complementary in design to the forcing element, so that reference can be made to the above statements with regard to the gradients.

The at least one recess of the cylindrical snap-on pipe, again viewed from outside in a radial direction, is essentially triangular, possibly with rounded edges or a rounded upper edge, wherein one side of the recess, at least a partial area, is inclined more steeply than the other side of the recess, wherein reference is here also made to the above statements.

In another preferred embodiment, the at least one threaded segment of the dispensing element has a gradient of approx. 2° to approx. 20°, preferably from roughly 5° to approx. 15°, wherein the gradient measures roughly 10° in an especially preferred embodiment. A preferred embodiment further provides an additional partial area on the at least one threaded segment that exhibits a gradient of roughly 0°, meaning runs essentially horizontal. The advantage to this configuration in particular is that, in cases where there is a certain clearance between the dispensing closure on the one hand and spout or dispensing opening on the other for essentially manufacturing-related reasons, which enables an easy relative rotation of the two elements relative to each other, the latter does not automatically result in a suspension of the dispensing closure, meaning an axial relative motion between the dispensing closure and container or dispensing element.

The invention further relates to a dispensing closure for a closure system of the kind described above.

A dispensing closure according to the invention for a closure system is designed as a so-called rebounding closure, and comprises an essentially cylindrical snap-on pipe, the inside of which is provided with at least one threaded segment.

The essentially cylindrical jacket of the snap-on pipe exhibits at least one recess, wherein this recess is provided on the inner side or the side of the jacket of the snap-on pipe facing the container. The closure edge of the lower area of the snap-on pipe or the area facing the container preferably runs essentially horizontal, wherein the term horizontal is understood as a directly perpendicular to an axial direction of the dispensing closure or perpendicular to a dispensing opening of an accompanying container (if the dispensing closure is placed on a container). In conventional containers or bottles, the terms horizontal and vertical hence correspond to the actual horizontal and vertical conditions existing when a dispensing closure is placed on a container, and the latter is standing on a solid base, with the dispensing opening facing up, for example. However, the dispensing closure according to the invention and closure system according to the invention are of course applicable to any other containers, for example on tubes with a dispensing closure that can be placed on the dispensing closure itself, with the dispensing opening facing down.

According to the invention, the at least one recess of the dispensing closure is designed in such a way that, proceeding from the lower edge of the jacket of the snap-on pipe, the recess progress in such a way that a gradient to the horizontal smaller than 90° is present on the one side, and is less than the gradient on the opposing side, at least in a point or an area of the respective gradient.

Let it be understood in this conjunction that the sides of the recesses exhibit two opposing gradient areas, which are separated from each other either by a vertex or a vertex area that runs essentially horizontal over a certain area, or meet or converge at this vertex/vertex area.

While the two gradient areas can preferably run along a straight line at least over a partial area, it is also possible for the gradient to change once, several times, or even continuously at specific points of the gradient area. The at least one recess is preferably designed in such a way that the gradient on the one side up to the vertex or vertex area is always (or at least over a large area) smaller than or equal to the gradient of the opposing area, wherein the two opposing gradients are always compared at points that oppose each other in a horizontal direction, i.e., lie on points along a line running parallel to the plane that is always clamped by the lower edge of a cylindrical snap-on pipe (not taking into account the recess itself), or parallel to a plane perpendicular to the dispensing opening or dispensing direction.

The recess is preferably configured in such a way that two areas can be distinguished in a vertical direction, wherein the opposing flanks or recess areas exhibit an identical gradient in an upper area, meaning in an area starting at the vertex or vertex area, so that the recess in this area is preferably mirror-symmetrical in design relative to a vertical axis, which runs through the vertex or middle of the vertex area, while the recess, in an area located below in a vertical direction, meaning facing away from the vertex or vertex area of the recess and lying close to the lower jacket of the cylindrical snap-on pipe, exhibits a lower gradient on one side of the recess than the other recess, preferably a distinctly lower gradient. The gradient of this one area is preferably 50% lower than the gradient of the opposing area, with the gradient being half or even less the size.

Let it be noted at this juncture that the term gradient refers solely to the absolute values, the amount, meaning the progression of the lower edge of the snap-on pipe in the area of the recess relative to the horizontal, meaning relative to the plane defined by the lower terminating edge of the snap-on pipe, in an area that has no recess, regardless of the direction, meaning regardless of whether the height of the recess increases clockwise or counterclockwise.

The side of the recess where the gradient is greater at least at one point than on the opposing area preferably exhibits a gradient ranging from 60° to 90°, especially preferred from 75° to 90°, wherein areas very close to the vertical, but not quite vertical, are selected, especially between 80° and 89°, in particular ranging from 84° to 88°.

This very strong gradient near the vertical ensures in particular that the dispensing closure is not inadvertently turned in an undesired direction, in particular against the releasing direction.

In an especially preferred embodiment, the dispensing closure comprises at least two recesses of the kind described above, wherein these recesses are preferably arranged opposite each other in essentially the circumferential direction of the snap-on pipe. This ensures an especially reliable positioning of the dispensing closure on a corresponding spout or on a corresponding dispensing opening of a container, and hence a container itself.

While it is also possible to provide more than 2 recesses, for example 3 or 4 recesses, a smaller number of recesses increases the stability of the essentially cylindrical snap-on pipe, of course depending on the respective material selected, in particular with regard to an essentially radial expansion, so that a lower number of recesses is preferred.

Therefore, 2 recesses are preferred, since they combine the two aforementioned aspects in a particularly effective manner.

At least one recess is preferably designed in such a way in the vertical or axial direction that it extends over at least 50%, preferably over more than 60%, 70% or even more than 80% or 90% of the vertical extension of the jacket of the cylindrical snap-on pipe. While several embodiments can even provide that the recess extend over the entire area of the jacket of the snap-on pipe, at least a small web area or connecting area must also always preferably be provided between the parts of the jacket that are "separated" from each other by the at least one recess in the jacket area.

In a preferred embodiment, the dispensing closure further comprises a sealing cone designed within the snap-on pipe, preferably concentrically, with which a dispensing opening in a spout of a container can be sealed.

Use is preferably made of dispensing closures that comprise a closure body and hinged cover, which is hinged to the closure body. Of course, use can be made of other dispensing closures too, such as so-called "disk-top-closures.

BRIEF DESCRIPTION OF THE DRAWINGS

These and other advantages and features of the invention can be gleaned from the attached drawings, which depict especially advantageous embodiments. Shown on:

FIG. 5 is a partially cut side view of a closure system according to an embodiment with a dispensing closure of the kind depicted on FIGS. 1 and 2, and with a spout as depicted on. FIGS. 3 and 4;

DETAILED DESCRIPTION OF THE PREFERRED EMBODIMENTS

Figure 1:
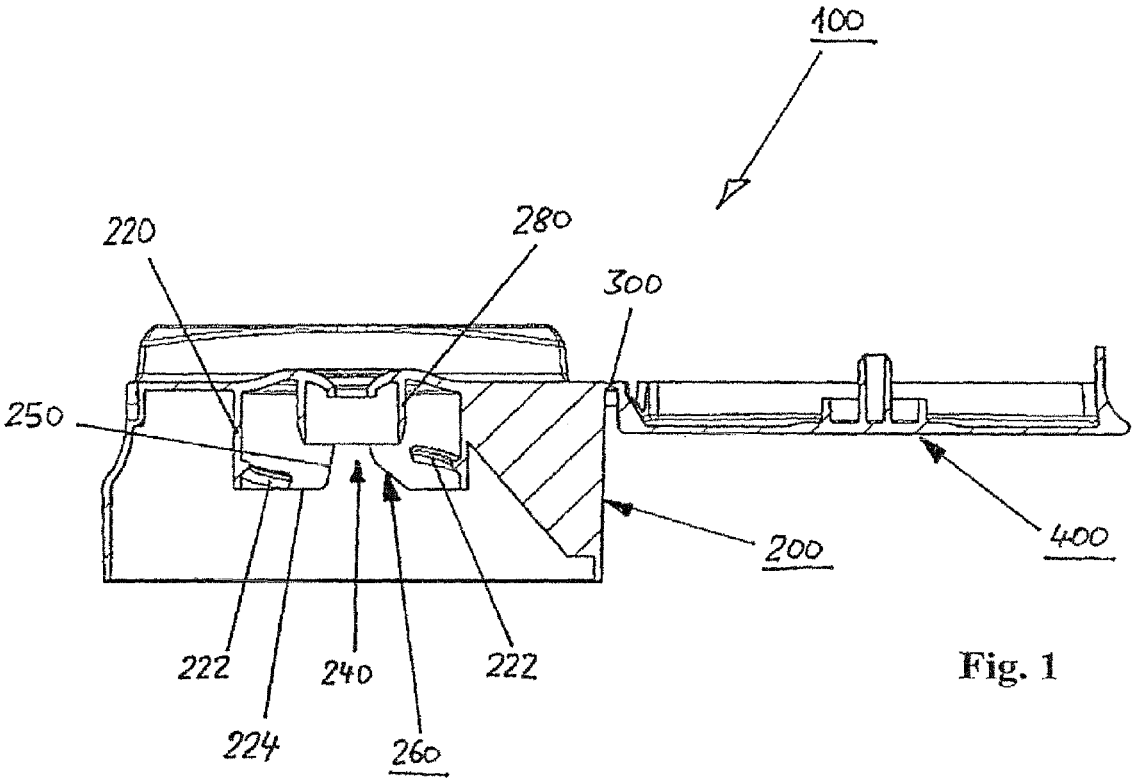
FIG. 1 is a partially cut side view of an embodiment of a dispensing closure for a closure system according to the invention.

FIG. 1 shows a partially cut side view of a dispensing closure 100, which comprises a closure body 200 and a cover 400, which is pivoted to the closure body 200 with a hinge 300. The closure body 200, which can be attached to a spout of a container with a dispensing opening (see in particular FIG. 5 and FIG. 6, along with the following description), comprises a snap-on pipe 220 with an essentially cylindrical jacket, the lower end of which ends in an essentially horizontally running terminating edge 224.

The inside of the snap-on pipe 220 is provided with 2 threaded segments 222, which can interact with accompanying threaded segments (622, see FIGS. 3 and 4) of a spout of a container, The snap-on pipe 220 exhibits two recesses 240 (only one visible on FIG. 1), which are arranged opposite each other in the circumferential direction of the snap-on pipe 220. The special shape of the recesses 240 will be described below in particular with regard to FIG. 6.

Figure 5:
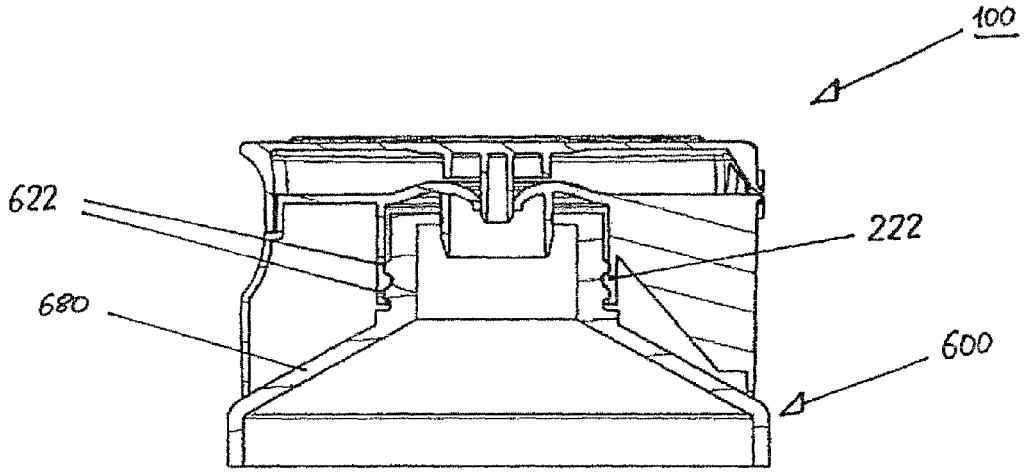

The closure body 200 further comprises a sealing cone 280, which, while being attached to a container or a spout, extends into a dispensing opening and seals it, see in particular FIG. 5.

Figure 2:
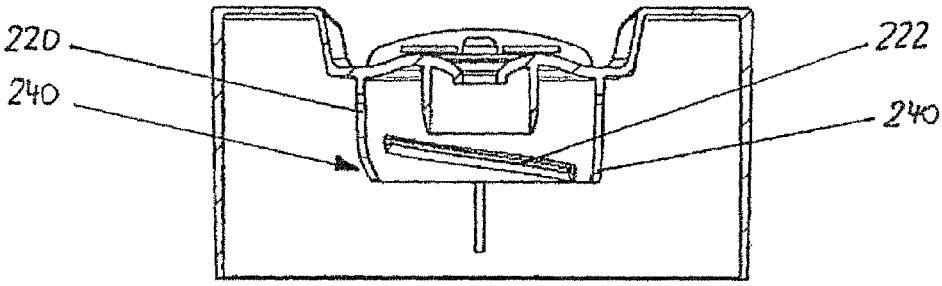
FIG. 2 is a partially cut front view of the dispensing closure shown on FIG. 1.

FIG. 2 shows a front view of the embodiment depicted on FIG. 1, Clearly visible here in particular is one of the threaded segments 222, which exhibits a gradient of approx. 10°. Let it also be noted at this juncture that the two recesses 240 on FIG.

2 are essentially located on the right or left side, even though difficult to see in light of the partially cut view, but provided with reference numbers.

Figure 3:
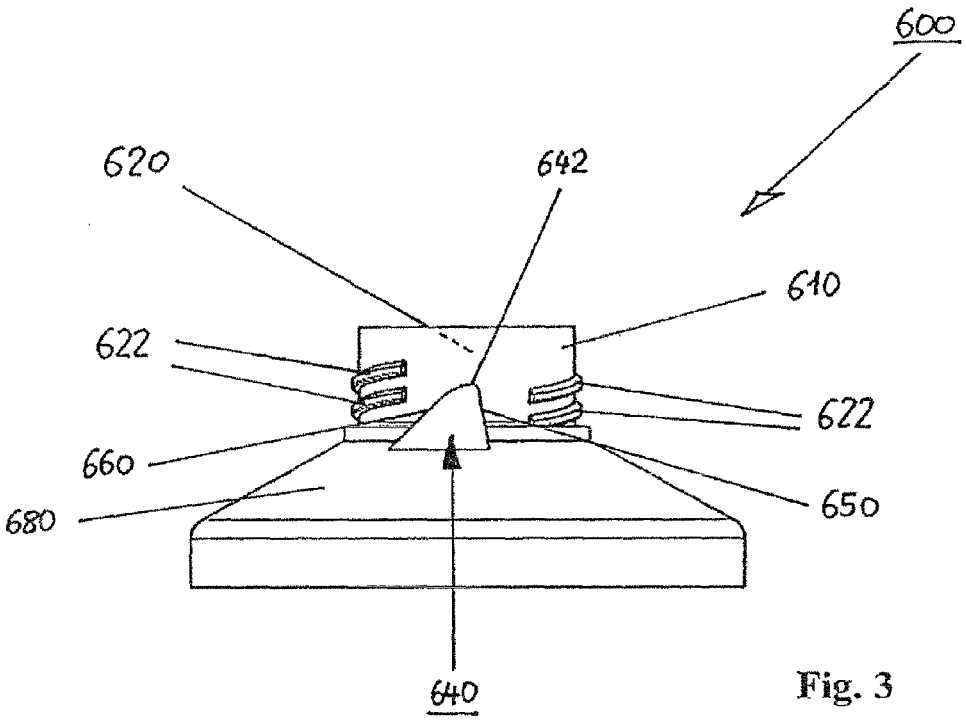
FIG. 3 is a side view of a spout based on an embodiment of a closure system according to the invention.

FIG. 3 shows a side view of a spout of a closure system according to the invention, onto which a dispensing closure of the kind depicted on FIGS. 1 and 2 can be placed.

The spout 600 of a container (not shown) comprises a dispensing opening 620, which is enveloped or formed by an essentially cylindrical neck area 610, the outside of which is provided with threaded segments 622, which interact with the accompanying threaded segments 222 of the dispensing closure 200 when the dispensing closure 100 (see FIG. 1) is attached to the spout 600.

The spout 600 of the closure system according to this embodiment comprises 2 forcing devices 640, arranged in opposing positions in the circumferential direction of the neck area 610 and on a shoulder area 680 of the spout 600. Each of the forcing devices 640 comprises a first side 650 and a second side 660, which are separated from each other by a vertex 642 or a vertex area. The gradient of the first side 650 runs essentially uniformly until shortly before the vertex, and exhibits a gradient of roughly 80°. The gradient of the second side also runs essentially along a straight line, but flattens out markedly before the vertex 642. The gradient of the second side 660 relative to the uniformly proceeding area preferably extending over approx. 60% to 90%, in particular 80% to 90% of the length of the second side 660 measures roughly 45°.

The function of these forcing devices as they interact with the snap-on pipe in the area of the recesses becomes evident in particular in conjunction with FIG. 7, and will be explained below.

Figure 4:
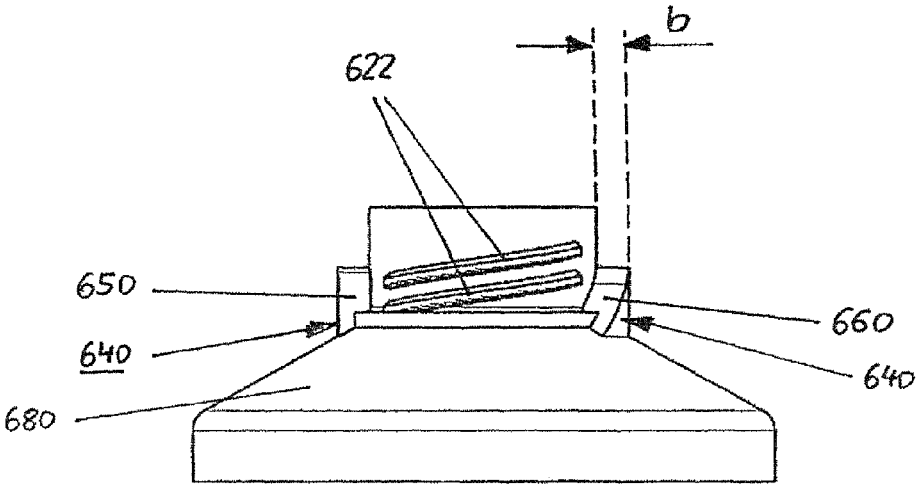
FIG. 4 is the spout shown on FIG. 3 in another side view, specifically in a view turned by 90° by comparison to FIG. 3.

FIG. 4 shows the spout as depicted on FIG. 3, but turned by 90°, meaning viewed from the right or left relative to FIG. 3. Clearly visible here are the two threaded segments 622 on the one side, as well as the first side 650 of one of the forcing devices 640 along with the second side 660 of the other forcing device 640.

Also clearly evident on FIG. 4 is the expansion of the forcing devices 640 in a radial direction b, which in this embodiment measures approx. 3 millimeters, and typically lies between 2 and 4 millimeters in other preferred embodiments, thereby ensuring that the forcing elements 640 with the accompanying elements of the snap-on pipe 220 interact, in particular as shown on *Fig.* 7.

FIG. 5 shows a partially cut view of both the dispensing closure 100 and the spout 600, so that reference is made to the description for FIG. 1 to 4 as relates to the individual elements.

Clearly evident on FIG. 5 is the interaction between the snap-on pipe 220 and its threaded segments 222 on the one hand and the neck area 610 with its threaded segments 622 on the other, thereby ensuring a reliable attachment of the dispensing closure on the spout. Since the dispensing closure involves a so-called rebounding closure, the closure system depicted on FIG. 5 is assembled by simply slipping or pressing or snapping the dispensing closure 100 onto the spout 600 from above in essentially an axial direction, during which the snap-on pipe 220 can expand in a radial direction, in particular owing to the recesses, so that the threaded segments 222 of the snap-on pipe 220 are pressed over the threaded segments 622 of the neck area 610.

Figure 6:
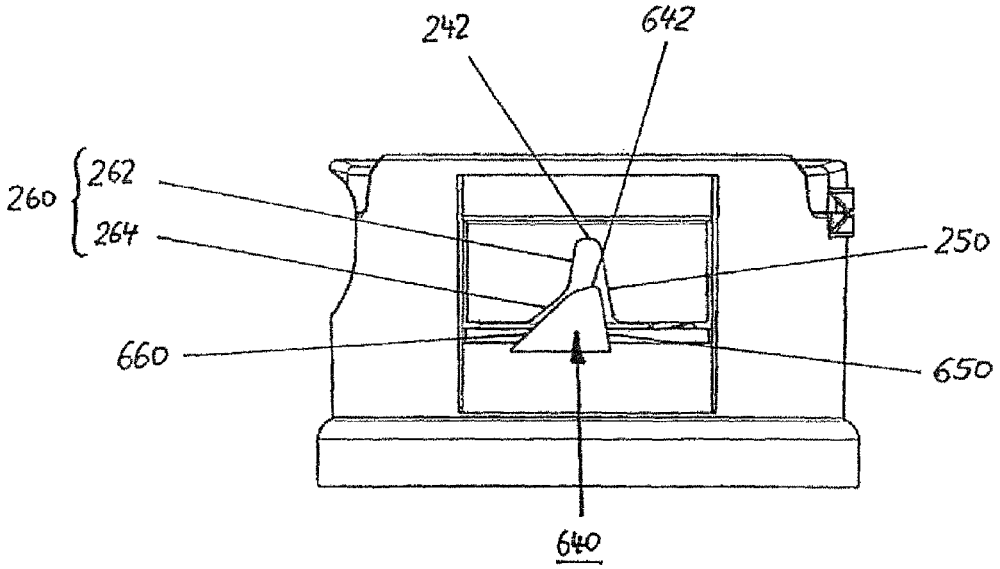
FIG. 6 is the embodiment shown on FIG. 5 in a partially cut view, but cut in other planes than depicted on FIG. 5.

FIG. 6 shows the embodiment depicted on FIG. 5, but with a partially cut area that deviates from FIG. 5. Clearly evident on FIG. 6 is the relative positioning and interaction of one of the recesses 240 of the snap-on pipe 220 with the accompanying forcing element 640.

Figure 7:
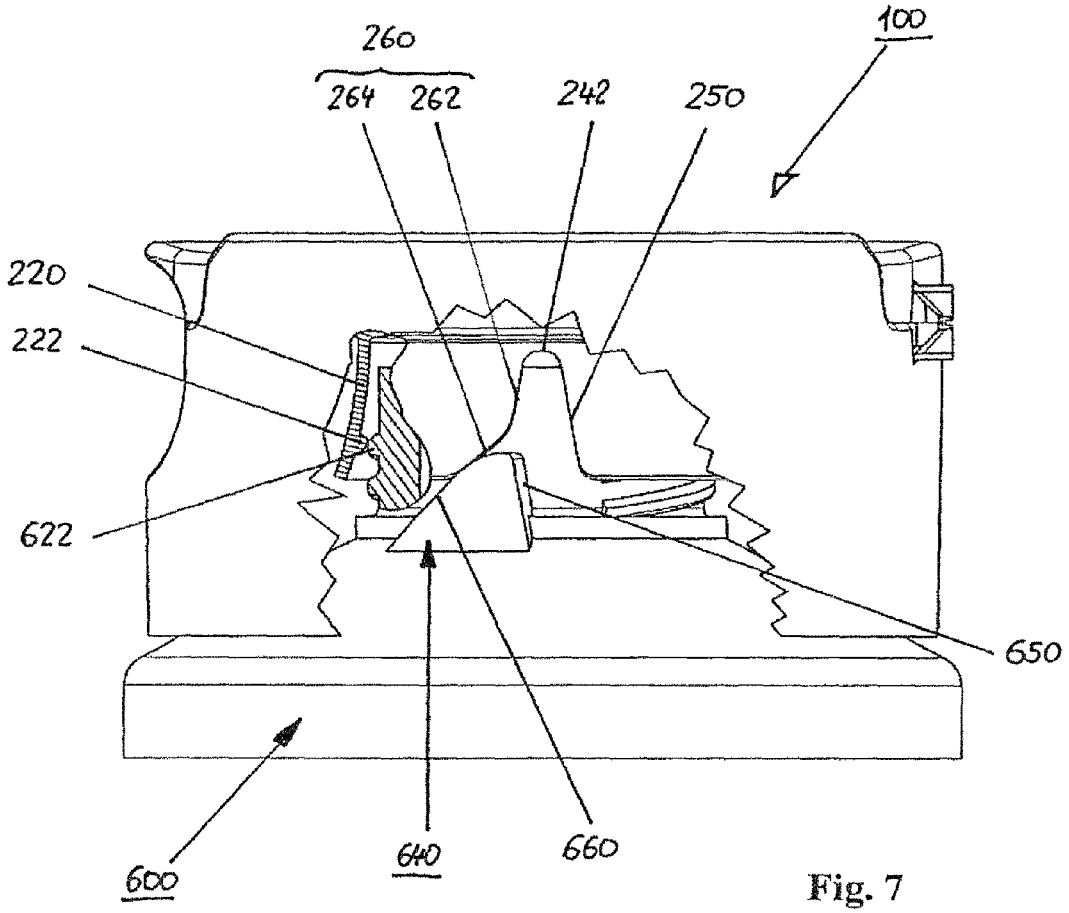
FIG. 7 is a partially cut view of the embodiment depicted on FIG. 1 to 6, wherein the dispensing closure is turned relative to the spout by a specific angle.

Let it be noted at this juncture that the first side 250 of the recess 240 on the right side of FIG. 6 interacts with a corresponding gradient of the first side 650 of the forcing element 640 with a very high gradient of roughly 80°, thereby impeding or even preventing a clockwise rotational motion of the dispensing closure, so that the first side 250 of the recess 240 moves toward the first side 650 of the forcing element 640, while enabling a counterclockwise expansion of the dispensing closure, since a slighter gradient 264 of the recess 240 interacts with the slighter gradient on the second side 660 of the forcing element 640, so that turning the dispensing closure counterclockwise presses up the dispensing closure in an axial direction as well, as depicted in particular on FIG. 7 described below.

While FIG. 7 shows the embodiment depicted on FIG. 6, a counterclockwise rotation of the dispensing closure 100 has already taken place by comparison to the attachment position presented on FIG. 6 (top view). As clearly evident, the interaction between the gradient 260, and in particular the partial area 264 of the gradient 260, the recess 240 and the accompanying or complementary gradient of the second side 660 of the forcing element 640 causes the dispensing closure to also be pressed up with a continuous rotational motion. This movement presses the threaded segments 222 of the snap-on pipe 220 over the threaded segments 622 of the neck area 610 of the spout, as enabled by the flexibility of the snap-on pipe 220, which is also caused by the recess 240 itself.

In this way, it can be ensured that a counterclockwise rotational motion of the dispensing closure, meaning in the usual opening direction, also exerts a force in the axial direction, which automatically separates the dispensing closure 100 designed as a rebounding closure from the spout or the container. Of course, it is also possible to design the dispensing closure and spout in such a way as to achieve a separation during a clockwise rotation, as described above.

Figure 8:
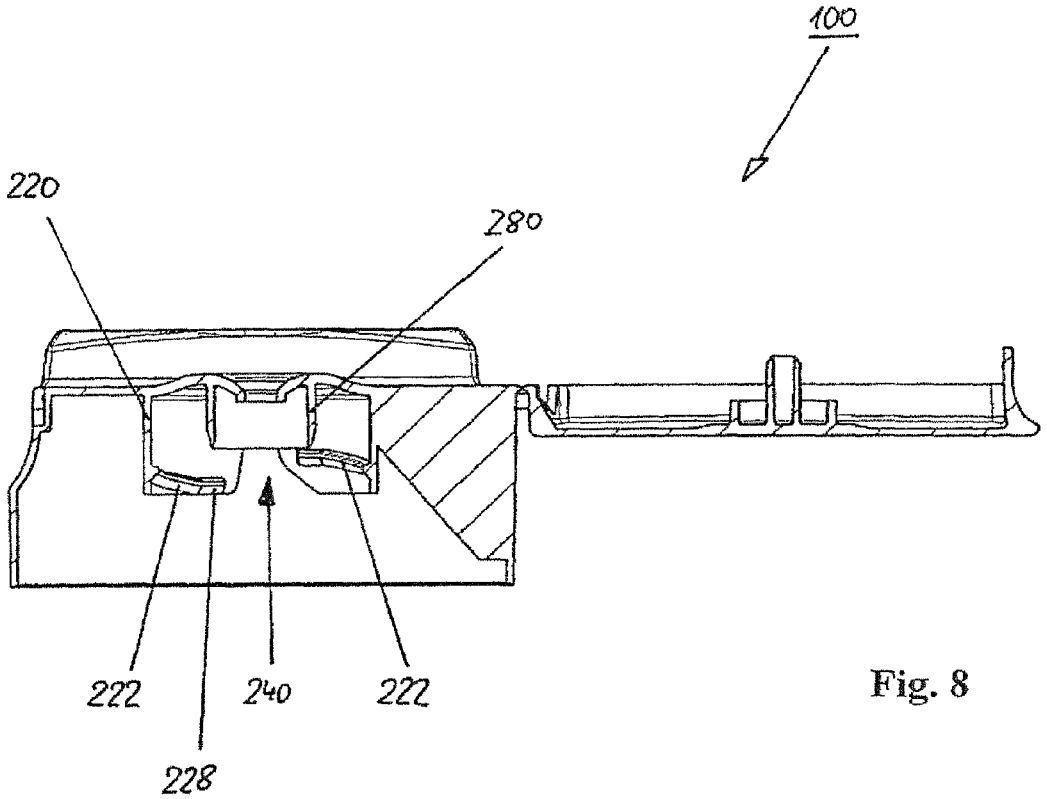
FIG. 8 is another embodiment of a dispensing closure according to the invention in a view depicted on FIG. 1 relative to the first embodiment.
Figure 9:
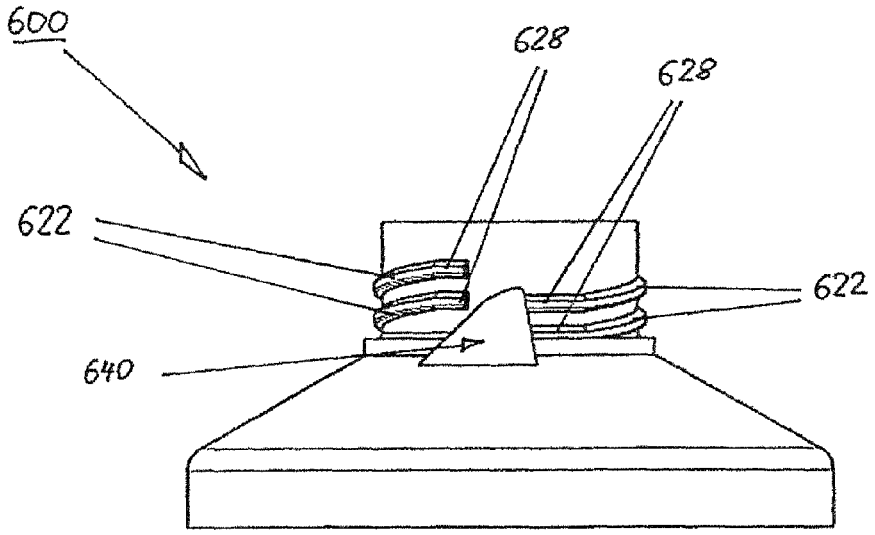
FIG. 9 is another embodiment of a spout according to the invention of a closure system based on the invention in the view depicted on FIG. 3 relative to the first embodiment.

FIGS. 8 and 9 depict another embodiment of a dispensing closure according to the invention for a closure system according to the invention and a spout of a closure system according to the invention. The elements of this embodiment essentially correspond to the embodiments shown on FIG. 1 to 7, so that reference is made to the description for FIG. 1 to 7 to avoid repetition. The same or similar elements have been provided with identical reference numbers.

The difference in the embodiments depicted on FIGS. 8 and 9 involves the design of the threaded segments 222, 228 of the snap-on pipe 220 on the one hand, and the accompanying threaded segments 622, 628 on the neck area 610 of the spout. The threaded segments 222 and 622 essentially run as shown in the embodiments depicted on FIG. 1 to 7, but short, horizontally running partial segments 228, 628 follow these threaded segments 222, 622, which exhibit a gradient.

These additional horizontally running threaded segments 228, 628 result in a situation where, even given a slight relative rotational motion of the dispensing closure 100, no forced vertical relative motion of the dispensing closure is generated in relation to the spout. This ensures that no axial movement of the dispensing closure will be caused by even a slight relative rotational motion, which can in part not be avoided owing to clearance and manufacturing accuracies, which supports the attachment and tightness during the use of the dispensing closure or closure system, or a container with such a closure system.

The features disclosed in the above description, claims and drawings can be of importance in implementing the invention in its various embodiments, whether taken individually or in any combination.

What is claimed is:

1. A closure system that comprises a dispensing closure (200) and a spout (600) of a container or for a container, on which the dispensing closure (200) can be attached, wherein the dispensing closure (200) is designed as a rebounding closure, wherein the spout (600) comprises an essentially cylindrical dispensing element (610) with a dispensing opening (620), the outside of which is provided with at least one threaded segment (622), and the dispensing closure (200) comprises an essentially cylindrical snap-on pipe (220), the inner side of which is provided with at least one threaded segment (222) for interacting with the at least one threaded segment (622) of the dispensing opening (620), characterized in that the outside of the dispensing element (610) is provided with at least one forcing device (640), which is designed to engage at least one recess (240) of the snap-on pipe (220) so as to force the dispensing closure (200) to move in an axial direction when turning the dispensing closure (200) attached to the spout (600), so that the at least one threaded segment (222) of the snap-on pipe (220) is pressed over the at least one threaded segment (622) of the dispensing element (610), thereby releasing the dispensing closure (200) from the spout (600); and wherein the at least one recess (240) comprises a first side (250) and a second side (260), which converge at a vertex (242) or vertex area, wherein the gradients of the first and second side of the recess (240) are designed in such a way that a gradient on one of the first and second sides is smaller at least at one point than the gradient on the other of the first and second sides at a point lying at the same axial height.

2. The closure system according to claim 1, characterized in that the dispensing element (610) comprises at least two threaded segments (622).

3. The closure system according to claim 1, characterized in that the snap-on pipe (220) of the dispensing closure (200) comprises at least two threaded segments (222).

4. The closure system according claim 1, characterized in that the dispensing element (610) comprises at least two forcing devices (640).

5. The closure system according claim 1, characterized in that at least one forcing device (640) is ramp-shaped in design.

6. The closure system according to claim 1, characterized in that a dimension of the at least one forcing device (640) is greater in a radial direction from a centerline of the closure system than the radial dimension of the at least one threaded segment (622) of the dispensing element (610) and/or greater than the radial thickness of the snap-on pipe (220).

7. The closure system according to claim 1, characterized in that the snap-on pipe (220) comprises at least one recess (240) designed in such a way as to at least partially accommodate a forcing device (640) in a state in which the dispensing closure (200) is attached to the spout (600).

8. The closure system according to claim 1, characterized in that a gradient of the at least one threaded segment (622) of the dispensing element (619) and/or the at least one threaded segment (622) of the snap-on pipe (220) ranges from 2° to 20°, preferably from 5° to 15°.

9. The closure system according to claim 1, characterized in that the at least one threaded segment (622) of the dispensing element (610) and/or the at least one threaded segment (622) of the snap-on pipe (220) additionally exhibits a partial area having a gradient of 0°.

10. The dispensing closure according to claim 1, characterized in that at least two recesses (240) are provided.

11. The dispensing closure according to claim 1, characterized in that the recess (240) extends in an axial direction over at least 50% of the height of the snap-on pipe (220).

12. The dispensing closure according to claim 1, characterized in that the dispensing closure also comprises a sealing cone (280) inside the snap-on pipe (220).

13. The dispensing closure according to claim 1, characterized in that the dispensing closure involves a hinged cover seal, which comprises a hinged cover (400) attached to a closure body (200) by a hinge (300).

* * * * *